United States Patent [19]

Bowyer et al.

[11] Patent Number: 4,678,194

[45] Date of Patent: Jul. 7, 1987

[54] TARGET APPARATUS INCLUDING TRANSMITTING/RECEIVING DART

[75] Inventors: William H. Bowyer, Farnham; Robert L. Crocker, Farnham Royal; Christopher M. Hansford, Beaconsfield; Leslie K. Parker, High Wycombe; Nigel Gray, Winchester, all of England

[73] Assignee: Viragate Limited, London, England

[21] Appl. No.: 624,665

[22] PCT Filed: Oct. 18, 1983

[86] PCT No.: PCT/GB83/00264

§ 371 Date: Jun. 18, 1984

§ 102(e) Date: Jun. 18, 1984

[87] PCT Pub. No.: WO84/01618

PCT Pub. Date: Apr. 26, 1984

[30] Foreign Application Priority Data

Oct. 18, 1982 [GB] United Kingdom ..... 8229686

[51] Int. Cl.[4] ..... A63B 63/00

[52] U.S. Cl. ..... 273/373; 273/404

[58] Field of Search ..... 273/403, 404, 408, 410, 273/371, 373, 374

[56] References Cited

U.S. PATENT DOCUMENTS

| | | | |
|---|---|---|---|
| 3,112,110 | 11/1963 | Schulman | 273/373 |
| 3,396,971 | 10/1965 | Estep | 273/403 |
| 4,244,583 | 1/1981 | Wood et al. | 273/373 |

FOREIGN PATENT DOCUMENTS

| | | | |
|---|---|---|---|
| 2030877 | 4/1980 | United Kingdom | 273/373 |

*Primary Examiner*—Richard C. Pinkham
*Assistant Examiner*—MaryAnn S. Lastova
*Attorney, Agent, or Firm*—Stevens, Davis, Miller & Mosher

[57] ABSTRACT

The present invention relates to a target having conductive fibres in a plurality of beds into which a transmitting/receiving projectile may be embedded with a portion of the projectile remaining protruding from the target. Each bed indicates a score and is electronically insulated from the other. In some embodiments the separate scoring portions of the target transmit different signals with the signal from the projectile embedded in that portion of the target being radiated at a greater strength. The strongest signal (indicative of the portion of the target struck) is received by a nearby receiver and the score displayed. An alternative embodiment utilizes an externally transmitted signal and the projectile acts as a receiving antenna, conveying the signal to only that target bed in which the projectile is embedded and the individual beds are connected to the scoring display system.

16 Claims, 11 Drawing Figures

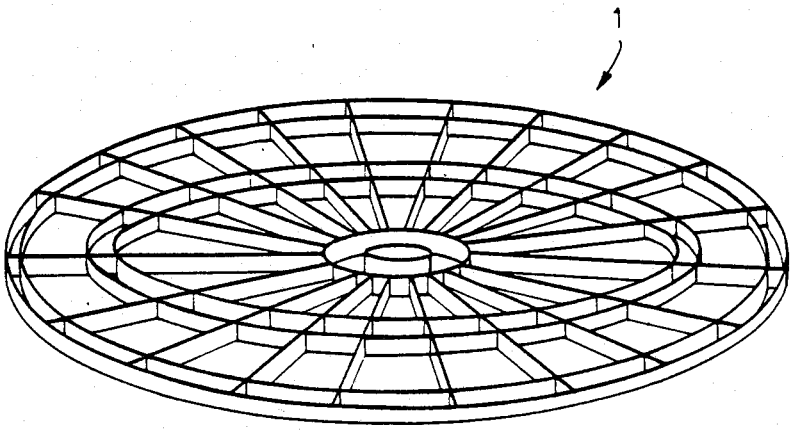
Fig. 1.
Fig. 2.
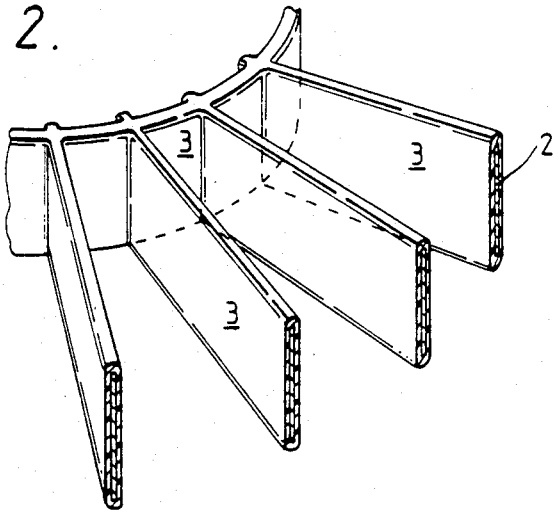

Fig. 3
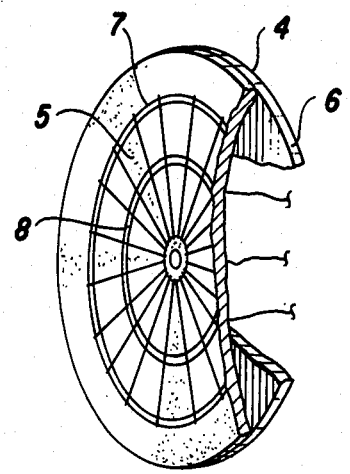
Fig. 4a
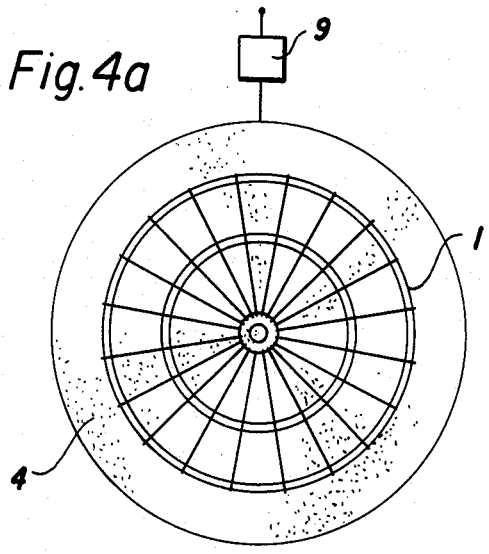
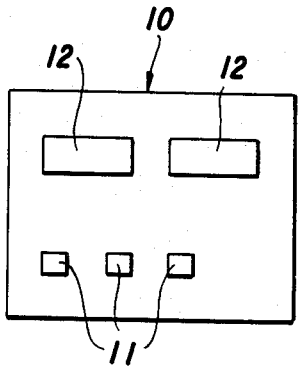
Fig. 4b

TARGET APPARATUS INCLUDING TRANSMITTING/RECEIVING DART

The present invention relates to a target apparatus, and more particularly relates to a target apparatus incorporating a target of the type into which a projectile may be embedded, with part of the projectile still protruding from the target. Examples of such targets are dart-boards and archery targets.

In this specification, the invention will be described with prime reference to a dartboard, but it is to be understood that the invention may be applied to other similar targets, such as an archery target, if the appropriate modifications are made.

Various attempts have been made to provide an automatic scoring dartboard. Some of these attempts have involved the use of mechanical devices, such as the arrangement described in British Patent Specification No. 1,370,609. In this arrangement when a dart hits the target, a member moves and an appropriate electronic signal is generated. The disadvantage with this type of target is that the target involves many moving parts, which can go wrong, and also the dart does not become embedded in the target in the same way that the dart would become embedded in an ordinary dartboard.

British Patent Specification No. 1,603,792 describes a different arrangement in which the dartboard is provided with a number of superimposed conducting layers, that are insulated from each other. As a dart becomes embedded in the dartboard the point of the dart interconnects the various layers, and consequently electric signals can be passed from one layer to another to provide an indication of the precise location of the dart. One disdavantage with this particular arrangement is that the conductive layers are formed of a conductive foam material. Thus the described dartboard does not have the same "feel" and does not have the same playing characteristics as a conventional dartboard. Also, in areas of the dartboard where the darts land frequently, for example the triple-twenty region, the foam is soon severely damaged by the points of the darts, and looses its conductive characteristics.

According to one aspect of this invention there is provided a target in which projectiles may be embedded, said target comprising a fibrous body, at least part of the front face of the target being formed from fibres that are, or have been treated to be, conductive at least on the outer surfaces thereof adjacent the face of the target.

Preferably the target face is divided into a plurality of beds, the fibres in each bed being insulated from the fibres in the other beds.

The target may comprise a rigid backboard and a plurality of fibres that extend substantially normally to that backboard, the free ends of the fibres defining the front face of the target. The fibres may be formeed of a conductive material, and thus may be carbon fibres, or metallic fibres, or the fibres may have been treated to make the fibres conductive.

Preferably the fibres are vegetable fibres that have been at least partly coated with metal or with conductive metal oxide. The coating may be applied chemically, or may be vacuum deposited, or said coating may be provided by spraying the fibres with metal vapours.

In one embodiment of the invention said coating may be applied by spraying the fibres with a succession of different vapours which form appropriate conductive compounds or compositions on the surfaces of the fibres.

If the fibres are treated vegetable fibres then the fibres may be moistened with ionically conductive liquids, and conveniently said liquids are provided with a hygroscopic component to prevent the fibres drying out. Advantageously said hygroscopic component is glycerol. surface of each of the fibres may be modified chemically to produce a conductive skin. Thus, the surface of the fibres may be charred, for example by the application of laser light.

Preferably the fibres are coated with graphite by being treated with a liquid comprising a suspension of finely divided graphite. This may be done before or after the board is fabricated. Preferably the mositure content of the fibres is allowed to stabilise and the fibres are then coated with a water proofing agent before the fibres are treated with the graphite suspension.

The target may be divided into separate beds by bed separator means inserted into the target after the target has been initially fabricated. Alternatively the target may be fabricated by preparing a plurality of separate zones of fibres and then securing said zones of fibres to said backboard with appropriate means separating the beds. The target may be in the form of a dartboard, the beds corresponding with the playing zones of the dartboard.

Preferably conductive means are provided connected to each of said beds to enable a separate signal to be applied to each bed, and aerial means are preferably provided to respond to a signal radiated from a dart protruding from any bed.

In one embodiment the fibres in adjacent beds constituting the target are insulated from each other by a separator member formed of insulating material and having at least one inner conductor, said inner conductor acting as an electric shield between the two beds. The separator member may be constituted by a member of glass fibre reinforced plastic material with an inner conducting core such as a core of copper foil, but in a preferred embodiment the separator is a moulded member. The faces of the separator that touch the various beds may be coated with a conductor to provide electrical contacts to the beds.

According to another aspect of this inventin there is provided a target apparatus comprising a target of the type into which a projectile of conductive material may be embedded with part of the projectile still protruding from the target, and an associated automatic scoring arrangement, the target being divided into a plurality of separate beds each associated with a predetermined score that can be obtained by a player causing a projectile to become embedded in that bed, each bed incorporating electrically conductive means for applying an electrical signal which is specific to that bed to a projectile embedded in said bed, the apparatus further including an aerial or antenna for receiving electromagnetic radiation radiating from part of a projectile protruding from a bed, and means responsive to a received signal for determining the score atrributable to the projectile from which the radiation is emanating.

Preferably said aerial or antenna may surround the periphery of the target, and may be constituted by one or more parts of a wire framework mounted on the front face of the target.

Conveniently means are provided for supplying a phase signal to each bed, and means are provided for supplying an anti-phase signal to the said responsive means so that no response is produced when no dart is embedded in the bed, the responsive means being responsive to the increase in phase signal received or detected when a dart becomes embedded in the said bed.

The means for supplying the anti-phase signal may supply the anti-phase signal directly to the responsive means, or may supply the anti-phase signal to one or more conductive areas provided on the target. Said conductive areas may be provided on the rear face of the target. Preferably such conductive areas are located in positions, corresponding to the positions of said conductive beds on the front face of the target, and preferably the anti-phase signal is supplied to a conductive area that is substantially diagonally opposed to the bed to which the phase signal is supplied.

Conveniently means are provided for supplying a plurality of separate individually identifiable signals to the beds, a separate respective signal being supplied to each bed, the receiver or detector being associated with means for identifying each received or detected signal. One or more signals may be multiplexed between the beds. In one embodiment a single signal generator is provided, the single signal being multiplexed successively between the said beds. Alternatively the signals may comprise a plurality of signals each having a different respective freqeucny, there being a plurality of tuned circuits responsive to the individual frequencies associated with the receiver or detector. In one possible embodiment three signal generators are provided, each generating a signal having a different respective frequency, the multiplexer being arranged to multiplex a first signal between the conductive beds until a first dart is embedded in a bed, and the resultant transmitted signal has been received or detected, the multiplexer then continuously applying that first frequency to that bed, and multiplexing a second frequency among the remaining beds until a second projectile becomes embedded in a second bed, whereupon the multiplexer, still continuing to apply the first signal to the first bed, applies the second signal to the second bed, and multiplexes the third signal around the remaining beds.

Preferably means are provided for detecting changes in the amplitude of a received or detected signal to enable the apparatus to detect the arrival of a second projectile in a bed in which a first projectile has already become embedded.

The target may be mounted on means adapted to provide an output signal indicative of whenever there is an increment in the weight of the target, signals thus being provided whenever a projectile becomes embedded in the target.

A computing device may receive the signals from the receiving or detecting means, and from the weight monitoring means to provide signals to control a display board or panel.

In order that the invention may be more readily understood, and so that further features thereof may be appreciated, the invention will now be described by way of example with reference to the accompanying drawings, in which:

FIG. 1 is a perspective view of a spider used in making a dartboard.

FIG. 2 is an enlarged view of part of the spider with part thereof cut away;

FIG. 3 is a perspective view of part of the dartboard with part cut away;

FIG. 4 is a diagrammatic view of the apparatus ready for use;

Figure 5:
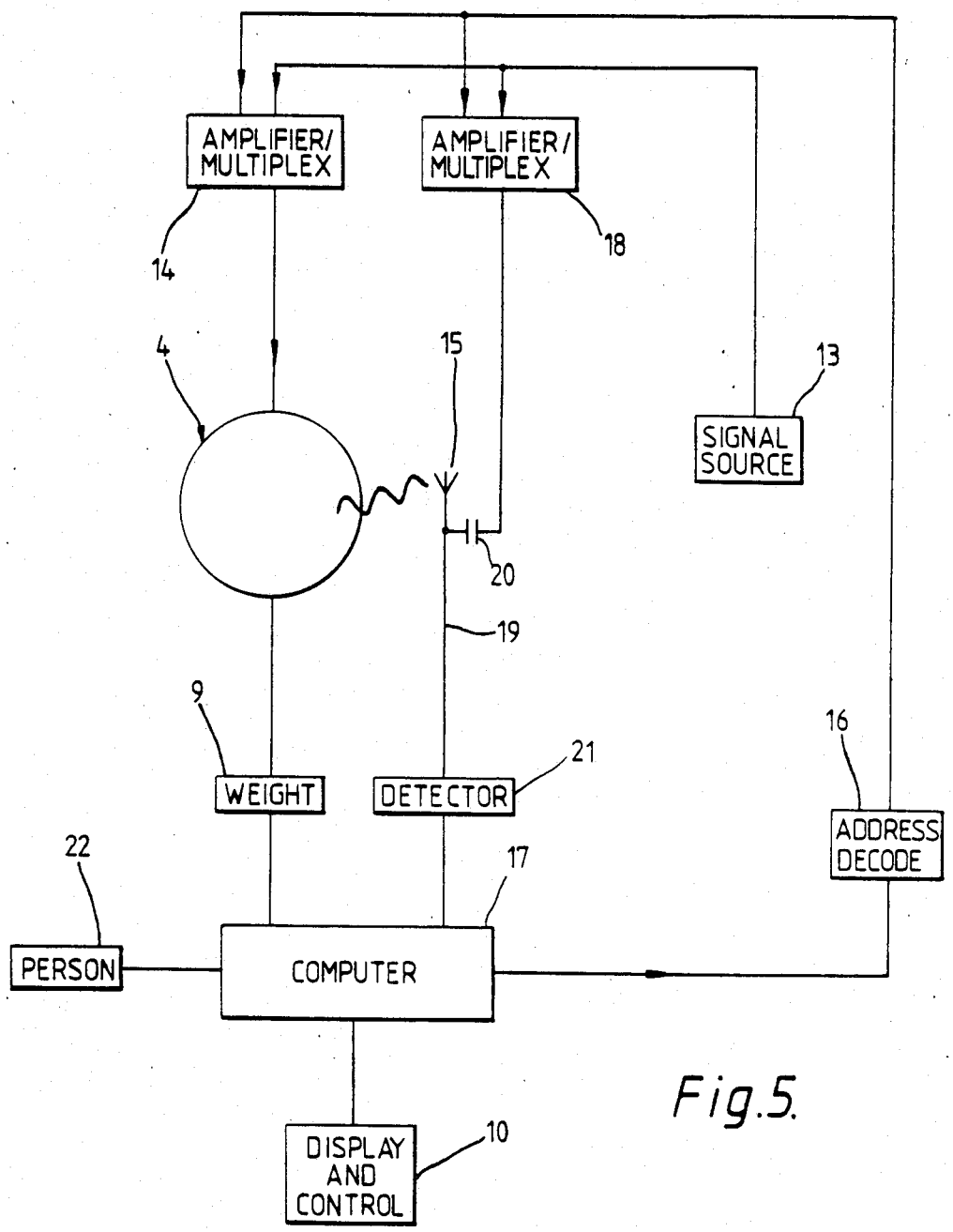
FIG. 5 is a block diagram of the apparatus.

FIG. 1 shows a structure that is termed a spider 1. The spider 1 has the configuration of the wire framework that is conventionally mounted on the front face of a dartboard to divide the dartboard into various beds. The score attributed to any dart thrown at the dartboard depends upon the precise identity of the bed in which the dart becomes embedded.

The structure of the spider is illustrated in FIG. 2. The spider is preferably of a molded construction. Each part of the spider has a central conducting region 2. This may be a metallic component e.g. copper foil or aluminium located in position during the molding process, but preferably the spider is moulded with recesses which are subsequently filled with a conducting material to form the conducting regions 2. The purpose of the conducting regions 2 will be described below. The conducting regions 2 are provided throughout the spider, and all the regions 2 are electrically interconnected.

Each part of the spider extends rearwardly from the front face, and the spider has a uniform depth. Each of the laterally facing parts of the spider are provided with a conducting element, such as a spray coating of copper, 3.

A conventional dartboard consists of a plurality of fibres of sisal which are bonded to, and which extend forwardly from a back board which may be of hardboard or chipboard. A dartboard 4, shown in FIG. 3, for use in the presently described embodiment of the invention consists of a plurality of conductive fibres 5 which extend forwardly from a backing member 6. The spider 1 is located within the mass of the fibres and serves to separate the fibres in each bed from the fibres in adjacent beds. A dartboard of this type may be fabricated by substantially conventional techniques utilizing conductive fibres. The fibres may be sisal fibres that have been coated with a waterproofing material and subsequently coated with a conductive material, for example by immersing in (or spraying with) or a suspension of graphite particles as sold under the Trade Mark "ELECTRODAG". The fibres are compressed whilst substantially parallel and are cut to have a planar end face. This is bonded to an appropriate backing sheet, which may be a temporary backing sheet having an aperture or perforated portions corresponding to the shape of the spider. The fibres are then cut again so that a pluarlity of short parallel fibre lengths remain bonded to the backing sheet. A hole is then cut in the assembly thus produced having a shape corresponding to that of the spider. The hole may be cut through the aperture or perforated portions of the backing sheet. The spider is then pressed into the hole to form separate beds in the target. The assembly may then, if desired, be bonded to a rigid permanent backing sheet.

Electric contacts are made with the electrically conducting core of the spider and with the various conducting elements on the laterally facing parts of the spider. This provides a separate electrical contact with each of the discrete beds of fibres. Instead of coating parts of the spider with conductive material conductive shims, eg. copper shims, may be slid between the spider and the fibres of each conductive bed. The spider may replace the conventional wire framework that divides the dartboard into separate beds, especially if the front face of the spider protrudes slightly from the front face of the dartboard.

At least one, and preferably two loops of wire are mounted on or adjacent the front face of the dartboard. The loops are preferably insulated so that a dart that is embedded in the dartboard cannot contact the wire electrically. The first loop 7 is located at the outer periphery of the scoring area of the board and the second loop 8 is located at the boundary between the "triple" scoring beds and the innermost region of "single" scoring beds. An electrical connection is provided to the loops which act as an aerial, as will be described. The loops may, of course, form part of a conventional wire framework if such a framework is provided, but in a preferred embodiment they are embedded in the appropriate parts of the spider being, of course, insulated from the conducting core 2 of the spider.

The dartboard 4 is mounted in position on a weight monitoring device 9. The device 9 may be located between the rear of the dartboard and the supporting wall. Associated with the dartboard in the described embodiment is a display and control panel 10. The display has two display windows 12 each to display the score of a respective player. The panel 10 also has some control buttons 11 to reset the apparatus and to enable players to choose the precise nature of the game to be played.

FIG. 5 is a general block diagram of one embodiment of the invention. A signal source 13 is provided which generates a signal having a frequency of approximately 35 KHz, and a peak-to-peak amplitude of appproximately 5.5 volts. The signal is applied to an amplifying and mutliplexing arrangement 14 which will be described in greater detail hereinafter. The arrangement 14 acts to apply the signal sequentially to each of the beds of the dartboard. The signal will be radiated and picked up by aerial 15 constituted by the loops 7 and 8. The multiplexers of the arrangement 14 are provided with appropriate controlling signals from an address decoder 16 which is controlled by a main computer 17.

Signals from the signal source are also supplied to a second amplifying and multiplexing arrangement 18, the amplifiers of which are controlled by signals from the address decoder 16. As will be explained in greater detail hereinafter the amplifying and multiplexing arrangement serves to supply to the aerial lead 19, via a capacitive coupling 20, a signal which cancels out the signal received by the aerial from the bed of the dartboard that is being energized at that instant. The aerial lead 19 is connected to a detector 21 to detect any signal present on the lead 19. However, since the signals provided from the amplifying and multiplexing arrangement 18 always cancel out the signals received through the aerial 15 when no dart is embedded in the board, no signal is detected.

The output of the detector 21 is connected to the computer 17. A detector 22 is provided to detect a person when at the playing position. This may be a pressure switch under the carpet at the appropriate position, or may be a heat sensitive detector, or may be an ultrasonic device or any other appropriate arrangement. By monitoring the signal supplied from the detector 22 the computer can ascertain when a player has finished throwing his three darts and leaves the playing position, even if all three darts have not stuck in the dartboard.

As will be understood from the following more detailed description of the electrical circuitry when a dart is thrown and sticks in the board the dart acts as an aerial. When the bed in which the dart is embedded is energized by the amplifying and multiplexing arrangement 14 the dart helps to transmit the signal. Thus, the signal picked up by the aerial is no longer cancelled out by the signal from the amplifying and mutliplexing arrangement 18. Thus the detector 21 detects a signal, and passes an output signal to the computer 17. The identity of the bed in which the dart landed can thus be determined and the appropriate score can be credited to the appropriate player.

Figure 6:
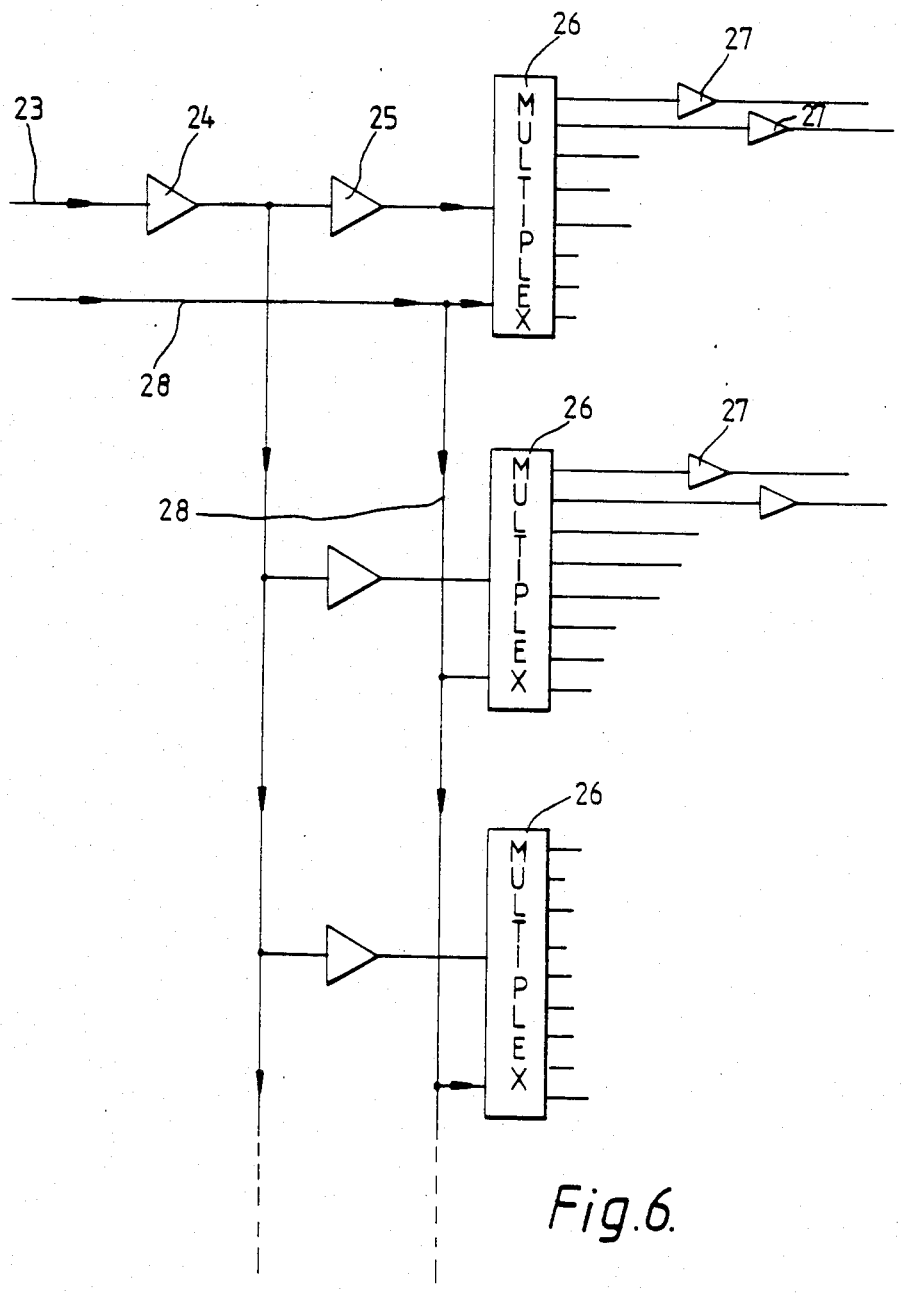
FIGS. 6 to 11 are more detailed circuit diagrams of the apparatus.
Figure 7:
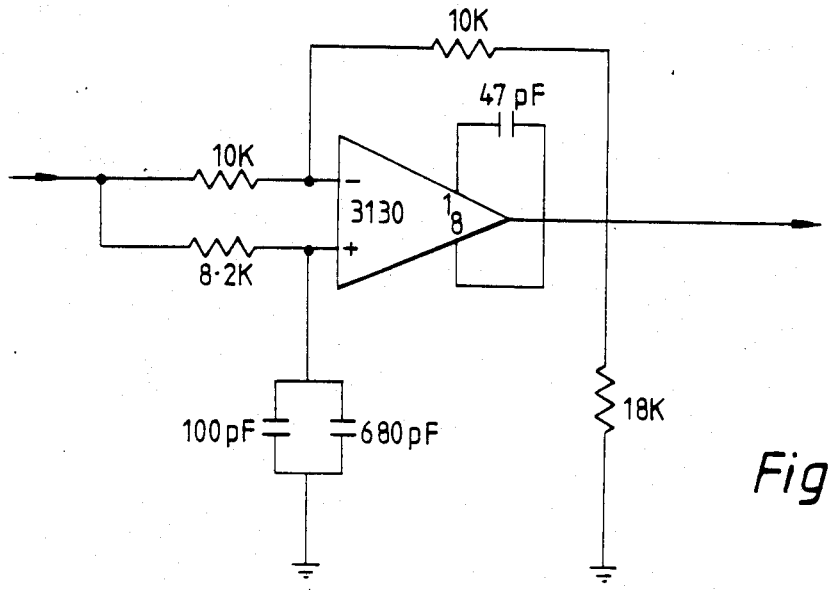
Figure 8:
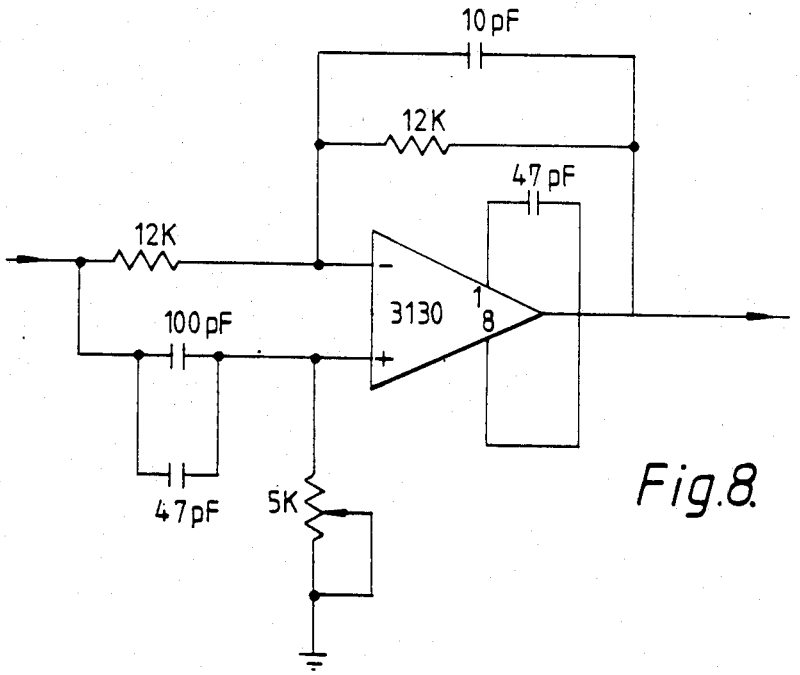

Turning now to FIG. 6 the amplifying and multiplexing arrangement 14 will now be described in greater detail. The 35 KHz signal from the signal source 13 passes along lead 23 and is fed to a circuit 34 which imparts a 90° phase lag to the signal with unity gain. The details of circuit 24 are shown in FIG. 7. The output of the circuit 24 is split eleven ways and passed to eleven phase advance circuits, only three of which are indicated in FIG. 6. Each phase advance circuit consists of a buffer circuit 25 the output of which is fed to a 1-to-8 analogue multiplexer 26. Each of the eight outputs of the multiplexer 26 is fed to a respective variable phase lead network 27. The details of one phase lead network 27 are shown in FIG. 8. The circuit may be adjusted to give a phase lead of between 80° and 110°. The outputs of the 88 variable phase lead networks connected to the outputs of the eleven multiplexers are individually connected by respective screened co-axial cables to respective conductive beds on the dartboard. The multiplexers 26 of the arrangement shown in FIG. 6 are supplied with control signals from the address decoder 16 through the lead 28.

Figure 9:
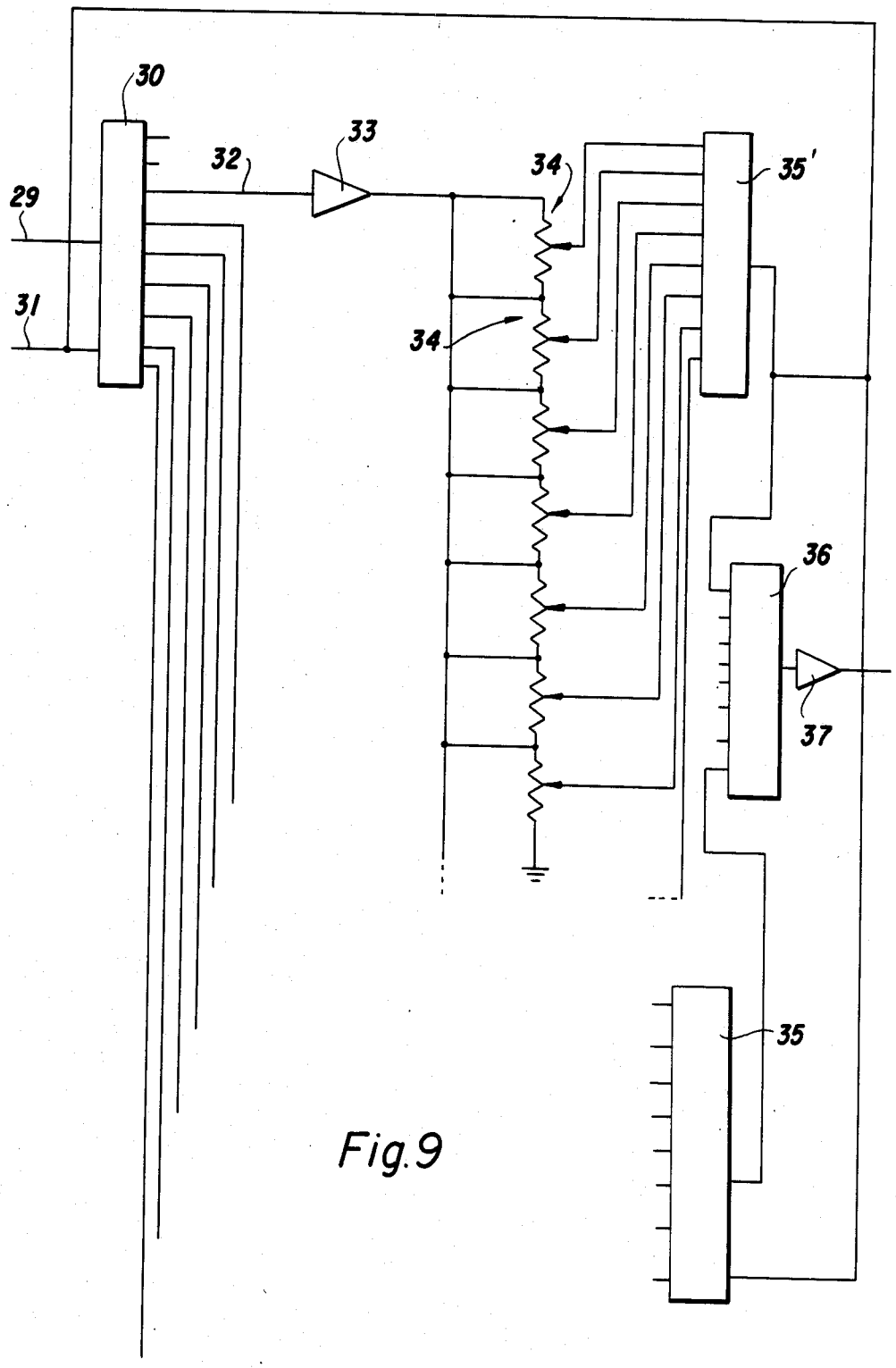
Figure 10:
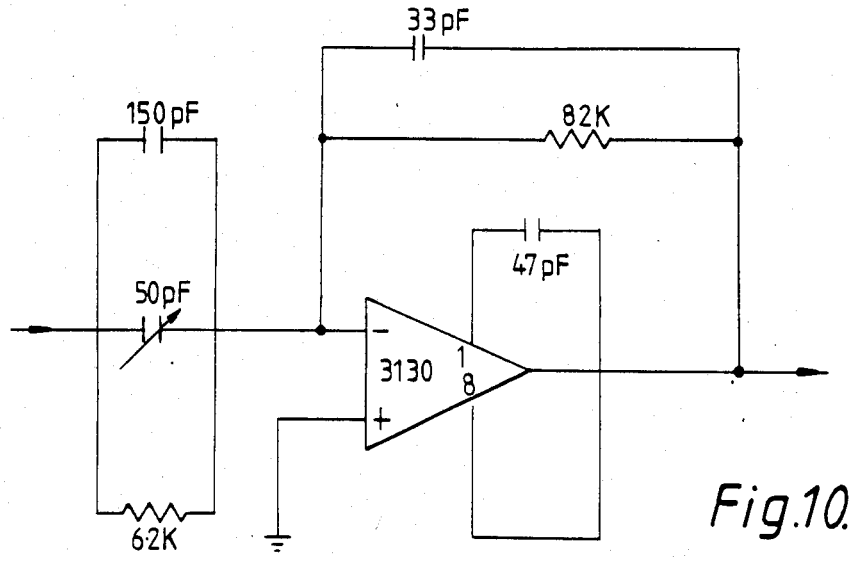

FIG. 9 illustrates in more detail the amplifying and multiplexing arrangement 18. The input signal on lead 29 is fed to a 1-to-8 multiplexer 30. The multiplexer 30, together with the other multiplexers in the arrangement which will be described below, is controlled by signals from the address decoder 16 which are supplied via the lead 31. Only six outputs of the multiplexer 30 are used, and each is connected to a respective attenuating and multiplexing network. Only one such network is partially shown in FIG. 9, but the remaining five networks corresponds. One output 32 of the multiplexer 30 is fed through a buffer 33 to the ends of the resistive elements of sixteen variable resistors 34 (only seven are shown). The other end of each resistor element 34 is grounded. The slides of the variable resistors are connected to the inputs of multiplexers 35, 35' two ouputs of which are connected to a further multiplexer, 36. The output of the final multiplexer 36 is connected to a phase inversion amplifier 37. Details of the phase inversion amplifier 37 are shown in FIG. 10. The signal that leaves each phase inversion amplifier is fed to the aerial lead by a D.C. blocking capacitor.

The aerial lead 19 is connected to a detector 21. The detector 21 consists of an initial broad band amplifier, followed by a narrow bandpass tuned amplifier which is tuned to the frequency of the signal generated by the signal source 13 e.g. 35 KHz. This in turn is followed by an envelope amplitude detector of the standard type as used in A.M. demodulation, although other types of amplitude detector may be used. The output of the envelope amplitude detector is digitized and fed to the computor as a binary coded signal.

The cables leading to the conductive beds of the dartboard each have a capacitance of between 65 and ↓pF. This is appropriate for the component values shown in the illustrated circuits. Any change of the capacitance of the leads would probably necessitate a recalculation of the components values of the variable phase advance circuits as shown in FIG. 8.

The address decoder 16 essentially comprises a 7 bit binary ripple counter (type 4024) and a 4 to 16 line decoder negative logic (type 4515B). As a clock count advances the described multiplexers are enabled appropriately so that the beds are sequentially energised, with a simultaneous energization of the appropriate path through the amplifying and multiplexing arrangement 18. The decoder 18 has a manual over-ride to enable the various beds to be energized sequentially under manual control. This facilitates setting up the system since it enables the beds to be energized sequentially for the period of time necessary to adjust the appropriate phase lead network 27 and variable resistor 34. Of course, the system will have to be balanced initially to provide the necessary initial conditions.

Figure 11:
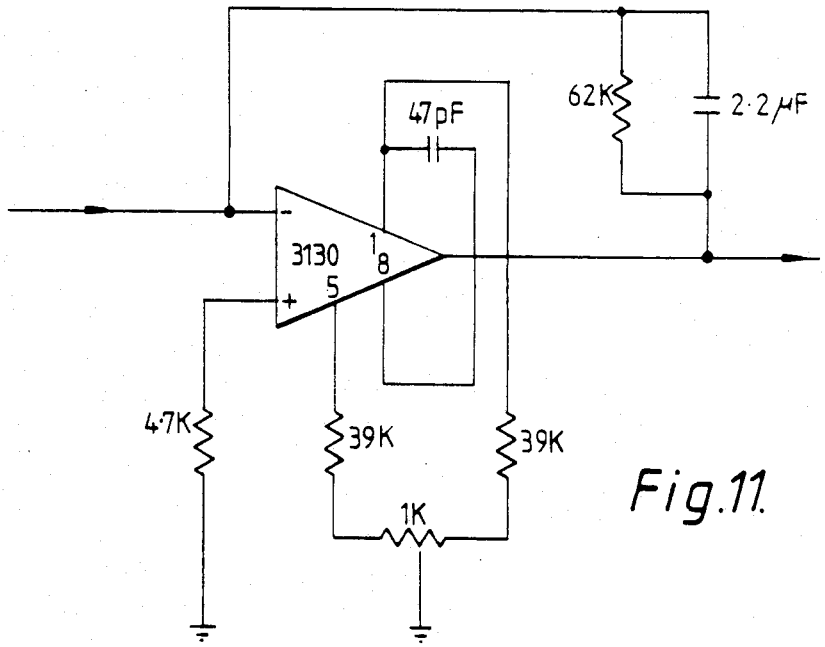

The weight of the dartboard is determined by four strain gauges present on elements that support the dartboard. The strain gauges are wired to form a bridge circuit. The output of the bridge circuit is amplified by a conventional strain gauge amplifier. The output of this amplifier is fed to the circuit shown in FIG. 11 which constitutes a D.C. amplifier with a zeroing adjustment. On setting up the arrangement the output of this amplifier is initially selected to be in the range of −1 to −4.5 volts.

The central core 2 of the spider is connected to earth. This serves to reduce capacitive coupling between adjacent beds, thus reducing crosstalk and minimizing initial balancing problems.

When the apparatus has been set up, an appropriate button 11 may be pressed to initiate the game. The first player stands at the playing position and is detected by the detector 22. The first dart is thrown at the board and becomes embedded in one bed. The weight detector 9 determines that the total effective weight of the dartboard has increased. The computer, via the address decoder, causes the various beds of the dartboard to be energized sequentially. When the bed in which the dart is embedded is energized the signal radiated by the bed is greater than when the apparatus was balanced and thus a single is detected by the detector 21 and passed to the computer 17. The computer determines the identity of the bed in which the dart has landed, calculates the score, and causes the score to be displayed. The score may be displayed as an increasing total, each player thus starting with a score of "0" displayed, the game ending when the winner reaches the score of "301" or "501" as may be appropriate. Alternatively the score may start at "301" or "501" for each player and may be reduced appropriately until the winner has a score of "0".

When the second dart is thrown and becomes embedded in the board the increase in the overall weight of the board will be detected and again the beds of the board will be energised sequentially. If the second dart is in a different bed from the first dart an appropriate signal will be detected when that bed is energized. Even if the two darts are touching, two signals will be detected, but the amplitudes of the signals would not be the same as when the darts are not touching. If the dart enters the same bed as the first dart the amplitude of the signal detected by the detector will be greater than the amplitude when only one dart was present in the bed.

When the third dart is thrown the procedure is repeated. If all three darts are in different beds three signals will be detected, even if two or more of the darts are touching. If the third dart enters a bed already occupied by one of the first two darts the signal radiated when that bed is energised will be greater than when there was only one dart in the bed. If the third dart enters a bed that is already occupied by the first two darts this will still be detected since the operational amplifiers utilized do not respond well to a capacitive load. With three darts in one bed the capacitive load applied to the operational amplifier is sufficient to deform the sine wave that is supplied to it. The deformed wave is transmitted. Since the wave received by the aerial is a deformed wave, and the signal applied to the aerial lead 19 through capacitor 20 is a sine wave the waves do not cancel out and an output is detected by the detector 21. Also, with three darts in one bed, the increase of weight of the board will demonstrate that three darts have become embedded in the board, and the reception of a signal only when one specific bed is energized will lead to the conclusion that all three darts are in one bed.

When three darts have become embedded in the board the player has finished his turn, and the computer will attribute the next three darts to the next player. In some cases, especially wwhen the players are not very skilled, one or more darts may fail to stick in the dartboard, or may fail even to hit the dartboard. The player may then end his turn with, for example, only one or two darts stuck in the board. The detector 22 will detect when the player leaves the playing position, and the computer will treat that event as being indicative of the end of the turn of that player. Of course, in an alternative arrangement a "reset" button may be provided on the central panel.

Whilst the invention has been described by way of example many modifications may be effected without departing from the scope of the invention.

The features disclosed in the foregoing description in the following claims and/or in the accompanying drawings may, both separately and in any combination thereof, be material for realizing the invention in diverse forms thereof.

The following is a computer listing that may be used with one embodiment of the invention.

```
4
]POKE1659.72
]LIST
1      REM  PROGRAM TO DECIPHER DARTBOARD SIGNALS
2      REM  CO NIGEL J GRAY AUGUST 1983
3      REM  ****************************
4      REM
5      REM
20      POKE 49372.128
30      GOSUB 2110: REM SCAN INITIALISATION
40     AC = 8: REM     NOISE ALLOWANCE F      O        R   WEI
       GHT.....
50     NPAUSE= 200: REM PAUSE PERIOD
60     AD =4: REM   BED NOISE ALOWANC      E
70     NU =81:REM     NUMBER OF BE              D
80      DIM VTEMP(NU): DIM BIN(NU)
90      DIM A(NU): DIM BZ(NU)
100      FOR N = 1 TO NU: READ A(N)
110      NEXT
120      DATA 6,3,9,3,34,17,51,17,4,2,6,2,30,15,45,15,20,10,30,10,12,
         6,18,6,26,13,39,13,8,4,12,4,36,18,54,18,2,1,3,1,40,20,60,20,
         10,5,15,5,24,12,36,12,18,9,27,9,28,14,42,14,22,11,33,11,16,8,
         24,8,32,16,48,16,14,7,21,7,38,19,57,19,25
130    Z = 0
140    M1 = 101:M2 + 101
150     HOME : PRINT ".........DART BOARD SCORER......."
160     PRINT "..PLAYER 1= "M1, "PLAYER 2="M2
164     IF Z = 0 THEN PRINT "PLAYER 1 TO THROW"
166     IF Z = 1 THEN PRINT "PALYER 2 TO THROW"
170     GOSUB 2150
180     IF F <> 255 GOTO 170
190    BWZ =  PEEK  (49360): BWZ = PEEK (49360)
200    BWZ =  PEEK (49360): BWZ =  PEEK (49360)
210     REM READ BED VOLTAGES WITH NO DARTS.
220     GOSUB 2190: REM READ BEDS.
230     GOSUB 2380
240     FOR N = 1 TO NU
```

```
250  BZ (N) = BIN(N):NEXT
260   REM ZERO SCORES
270  S1 = O:S2 = O:S3 = 0:ST = 0
280  P1 = O:P2 = O:P3 = 0
290   REM ZERO FLAGS
300  F1 = O:F2 = O:F3 = O:F4 = O:F5 = O:F6 = O
310   REM HAS DART BEEN DETECTED?
320   PRINT "    LOOKING FOR DART 1"
330   GOSUB 2310
340   IF D < BWZ + AC GOTO 330: REM NO!
350   REM DART 1 HAS BEEN DETECTED
360   PRINT : PRINT : PRINT: PRINT "  DART 1 DETECTED"
370   REM PAUSE FOR PERIOD
380   FOR PAUSE = 1 TO NPAUSE: NEXT
390   GOSUB 2310
400   IF D < BWZ + AC THEN F1 = 1: PRINT : PRINT "**DART 1 HAS
                                FALLEN OUT**": GOTO 520
410   REM DART STILL IN.....
420   GOSUB 2190
430  K = 0
440   FOR N = 1 TO NU
450   IF VTEMP (N) > BIN(N) + AD GOTO 480
460   NEXT
470   GOSUB 520
480   IF VTEMP(N) - BIN(N)      K GOTO 500
490   NEXT
500  P1 = N:K = (VTEMP (N)  - BIN(N))  :S1 = A(N)
510   NEXT
520   GOSUB 2380
530   GOSUB 2310
540  BX = D: REM CURRENT BOARD WEIGHT.
550   REM END OF THROW 1.........
555  ST = S1
560   PRINT : PRINT : PRINT "  FIRST DART SCORED  ",S1
565   GOSUB 2430
567  ST = ST - S1
570   REM  HAS DART2 BEEN DETECTED?
```

```
580   PRINT "     LOOKING FOR DART 2"
590   GOSUB 2310
600   IF D < BX + AC GOTO 590: REM  NO!
610   REM DART2 HAS BEEN DETECTED......
620   PRINT : PRINT "   DART 2 DETECTED"
630   REM PAUSE FOR A THINK...........
640   FOR PAUSE = 1 TO NPAUSE: NEXT
650   GOSUB 2310
660   GOSUB 2190
670   IF D > BX + AC GOTO 910: REM  WEIGHT GREATER....
680   IF D < BX - AC GOTO 900: REM  WEIGHT LESS
690   IF F1 = 1 GOTO 890:  REM   DART FELL OUT ON FIRST THROW
700   IF P1 = 0 GOTO 840:  REM   P1=0
710   IF VTEMP(P1) <  BIN(P1) - AD GOTO 730: REM SIGNAL HAS
      DECREMENTED.
720   GOTO 810
730   FOR N = 1 TO NU
740   IF VTEMP(N) >  BIN(N) + AD GOTO 790: REM SCORE FOR
      DART2.
750   NEXT
760  S1 = 0:S2 = 0:P1 = 0:P2 = 0
770   REM CONNECTION POINT.........
780   GOTO 1030
790  S2 = A(N):P2 = N:S1 = 0:P1 = 0
800   GOTO 770
810  S2 = S1:S1 = 0:P2 = P1:P2 = 0
820  F4 = 1: REM  SET FLAG 4
830   GOTO 770
840   FOR N = 1 TO NU
850   IF VTEMP(N) >  BIN(N) + AD GOTO 880: REM SCORE FOR
      DART2.
860   NEXT
870  S2 = 0:ST = 0:P2 = 0: GOTO 770
880  S2 = A(N):P2 = N: GOTO 770
890  F3 = 1:S2 = 0:P2 = 0: GOTO 770
900  F2 = 1:S2 = 0:P2 = 0:S1 = 0:P1 = 0: GOTO 770
910  F5 = 1
```

```
920    IF F1 = 1 GOTO 940:
930   F6 = 1
940   K = 0
950    FOR N = 1 TO NU
960    IF VTEMP(N) > BIN(N) + AD GOTO 990
970    NEXT
980    GOTO 1030
990    IF VTEMP(N) - BIN(N) > K GOTO 1010
1000   NEXT
1010  P2= N:S2 = A(N)
1012  K =VTEMP(N) - BIN(N)
1020   NEXT
1030   GOSUB 2380
1040   GOSUB 2310
1050   IF D     BX - AC GOTO 680
1060  BX = D: REM CURRENT BOARD WEIGHT.
1070  ST = S1 + S2
1080 PRINT : PRINT "  SECOND DART SCORED  ",S2: PRINT : PRINT"
       SCORE FOR TWO DARTS ",ST
1085   GOSUB 2430
1090   REM END OF THROW 2.............
      1100  GOSUB 2110
1110   REM *** LOOK FOR DART 3***
1120  PRINT "    LOOKING FOR DART 3"
1130   GOSUB 2310
1140   IF D < BX + AC GOTO 1130: REM NO!
1150   REM *** DART3 FOUND    ***
1160   PRINT : PRINT " DART 3 DETECTED"
1170   FOR PAUSE = 1 TO NPAUSE: NEXT
1180   GOSUB 2190
1190   FOR PAUSE = 1 TO 1000: NEXT
1200   GOSUB 2310
1210   IF D < BWZ + AC GOTO 1980: REM NO DARTS IN BOARD
1220   IF D > BX + AC GOTO 1880: REM        WEIGHT GREATER.
1230   IF D < BX - AC GOTO 1730: REM WEIGHT LESS
1240   REM WEIGHT SAME.......
1250   IF F6 = 1 GOTO 1400: REM FLAG6=1
```

```
1260  IF F1 = 1 GOTO 1280: REM FLAG1 = 1
1270  IF F4 = 1 GOTO 1370: REM FLAG4 = 1
1280  IF P2 =0 GOTO 1320: REM P2=0
1290  IF VTEMP(P2) < BIN(P2) - AD GOTO 1320: REM P2
      DECREMENTED.
1300  REM P2 NOT DECREMENTED
1310 S3 = O:ST = S2: GOTO 2180: REM  MULTICONNECTOR  POINT.
1320  FOR N = 1 TO NU
1330  IF VTEMP(N) > BIN(N) + AD  GOTO  1360:  REM  SCORE FOR DART3.
1340  NEXT
1350 S3 = O:ST  =O:  GOTO 2180
1360 S3 = A(N):ST = S3: GOTO 2180
1370  IF P1 = O GOTO 1320: REM P1=O
1380  IF VTEMP(P1) < BIN(P1) - AD GOTO 1320: REM P1 HAS
      DECREMENTED.
1390 S3 = O:ST = S1: GOTO 2180
1400  IF P1 = O GOTO 1650: REM P1=O
1410  IF P2 = O GOTO 1620: REM P2=O
1420  IF P1 = P2 GOTO 1600: REM P1=P2
1430  IF VTEMP(P1) < BIN(P1) - AD GOTO 1550: REM P1
      DECREMENTED.
1440  IF VTEMP(P2) < BIN(P2) - AD GOTO 1500: REM P2      "
1450  IF VTEMP(P1) > BIN(P1) + AD GOTO 1490: REM P1
      INCREMENTED.
1460  IF VTEMP(P2) > BIN(P2) + AD GOTO 1480: REM P2
      INCREMENTED.
1470 S3 = O:ST = S1 + S2: GOTO 2180
1480 S3 = S2:ST = S2 + S3: GOTO 2180
1490 S3 = S1:ST = S1 + S3: GOTO 2180
1500  FOR N = 1 TO NU
1510  IF VTEMP(N) > BIN(N) + AD GOTO 1540:  REM SCORE.
1520  NEXT
1530 S3 = O:ST = S1: GOTO 2180
1540 S3 = A(N):ST = S1 + S3: GOTO 2180
1550  FOR N = 1 TO NU
1560  IF VTEMP(N) > BIN(N) + AD GOTO 1590:  REM SCORE.
1570  NEXT
```

```
1580  S3 = O:ST = S2: GOTO 2180
1590  S3 = A(N): ST = S2 + S3: GOTO 2180
1600   IF VTEMP(P1) < BIN(P1) - AD GOTO 1500: REM P1
       DECREMENTED.
1610   GOTO 1470
1620   IF VTEPM(P1) < BIN(P1) - AD GOTO 1320: REM P1     "
1630   IF VTEMP(P1) > BIN(P1) + AD GOTO 1490:  REM P1
       INCREMENTED.
1640   GOTO 1500
1650   IF P2 = O GOTO 1320: REM P2=O
1660   IF VTEMP(P2) < BIN(P2) - AD GOTO 1320: REM P2
       DECREMENTED.
1670   IF VTEMP(P2) > BIN(P2) + AD GOTO 1480: REM P2
       INCREMENTED.
1680   FOR N = 1 TO NU
1690   IF VTEMP(N) > BIN(N) + AD GOTO 1720: REM  SCORE.
1700   NEXT
1710   GOTO 1580
1720  S2 = A(N): ST = S2 + S3: GOTO 2180
1730   IF F6 = 1 GOTO 1750: REM FLAG6=1
1740  ST = O: GOTO 2180
1750   IF  P1 = 0 GOTO 1860: REM P1=O
1760   IF P2 = 0 GOTO 1840: REM  P2=0
1770   IF P1 = P2 GOTO 1820: REM P1=P2
1780   IF VTEMP(P1) < BIN(P1) - AD GOTO 1800: REM P1
       DECREMENTED.
1790  S3 = O:ST = S3 + S2 + S1: GOTO 2180
1800   IF VTEMP(P2) < BIN(P2) - AD GOTO 1320: REM P2     "
1810  S3 = S2:ST = S3: GOTO 199
1820   IF VTEMP(P1)< BZ(P1) + AD GOTO 1320: REM NO DARTS IN P1.
1830  ST= S1: GOTO 2180
1840   IF VTEMP(P1)< BIN(P1) - AD GOTO 1320: REM P1
       DECREMENTED.
1850   GOTO 1790
1860   IF P2 = 0 GOTO 1320: REM P2 = 0
1870   GOTO 1800
1880  K = 0
```

```
1890   FOR N = 1 TO NU
1900   IF VTEMP(N) > BIN(N) + AD GOTO 1930
1910   NEXT
1920   GOTO 1970
1930   IF VTEMP(N) - BIN(N) > K GOTO 1950
1940   NEXT
1950  P3 = N:K = VTEMP(N) - BIN(N):S3 = A(N)
1960   NEXT
1970  ST = S1 + S2 + S3: GOTO 1990
1980  ST = 0
1990   REM CONNECTION POINT.............
2000   PRINT : PRINT "  DART 3 SCORED   ",S3
2010   PRINT : PRINT "****************************************": PRINT:
       PRINT: PRINT "   TOTAL SCORE = ", ST: PRINT : PRINT : PRINT
       ****************************************"
2020   GOSUB 2430
2030   IF Z = 0 THEN Z = 1:M1 = M1 - ST: GOTO 2060
2040   IF Z = 1 THEN Z = 0:M2 = M2 - ST
2060   GOSUB 2150
2070   IF F > 250 GOTO 2060
2080   GOSUB 2310
2090   IF D > BX - AC GOTO 2080
2100   GOTO 150
2100   REM SUBROUTINE TO RESET BED SCAN
2120   POKE 49375,128: REM  ZERO V     OLTS.
2130   POKE 49375,255: REM  + 5
2140   RETURN
2150   REM INTEREGATE PERSON
2160  F = PEEK (49362):F = PEEK (49362)
2170   RETURN
2180   GOTO 1990
2190   REM SUBROUTINE TO READ BOARD VALUES
2220   FOR N = 1 TO NU
2210  VTEMP(N) = PEEK (49371): VTEMP(N) = PEEK (49371)
2220  Q = VTEMP(N) - BIN(N)
2230   IF Q > 2 GOTO 2250
2240   IF (Q * ( -1)) < 2 GOTO 2270
```

```
2250  IF Q > 126 GOTO 2270
2260  PRINT N,Q
2270  GOSUB 2340
2280  NEXT
2290  GOSUB 2110
2300  RETURN
2310  REM SUBROUTINE TO READ BOARD WEIGHT.
2320 D = PEEK (49360):D = PEEK (49360)
2330  RETURN
2340  REM SUBROUTINE TO PULSE MULTIPLEXER
2350  POKE 49372,255: POKE 49372,128
2360  FOR PAUSE = 1 TO 15: NEXT
2370  RETURN
2380  REM SUBROUTINE TO REZERO BED VOLTAGES.
2390  FOR N = 1 TO NU
2400 BIN(N) = VTEMP(N): NEXT
2410  RETURN
2430  REM SUBROUTINE TO FINISH GAME
2440  IF Z = 0 GOTO 2470
2450 M2 = M2 - ST
2460  GOTO 2510
2470 M1 = M1 - ST
2480  IF M1 < 0 THEN PRINT "NO SCORE PLEASE REMOVE DARTS"
2490  IF M1 = 0 THEN GOTO 3000
2495  IF M1 > 0 THEN M1 = M1 + ST: RETURN
2500 Z = 1:M1 = M1 + ST: GOTO 2060
2510  IF M2 < 0 THEN PRINT "NO SCORE PLEASE REMOVE DARTS"
2520  IF M2 = 0 THEN GOTO 3000
2525  IF M2 > 0 THEN M2 = M2 + ST: RETURN
2530 Z = 0:M2 = M2 + ST: GOTO 2060
3000  PRINT:PRINT"*************************":PRINT:PRINT:PRINT:
      PRINT: PRINT: PRINT" YOU HAVE WON ": PRINT: PRINT"    AND I
      HAVN'T MADE ANY MISTAKES      ": PRINT:  PRINT:  PRINT
      "*************************"
3010  PRINT "DEDIDCATED TO UNCLE BILL WHO SHARES
      MY     LOVE OF D ARTS"
3020  PRINT : PRINT"       CO N.J.G 1983"
```

We claim:

1. A target in which projectiles may be embedded, said target including a target face, the target face being divided into a plurality of bed, the beds being formed from substantially parallel fibres that are, or have been treated to be, conductive at least on the outer surfaces of said fibres adjacent the face of said target, said fibres in each bed extending substantially normally to the target face and being insulated from the fibres in adjacent beds, further including a backing means for mounting said fibres substantially normal to said backing member, each of said fibres having a free end, where the free ends of said fibres define said target face wherein conductive means are provided connected to each of said beds to enable a separate signal to be applied to each bed, and wherein aerial means are provided to respond to a signal radiated from a dart protruding from any bed.

2. A target apparatus comprising a target of the type into which a projectile of conductive material may be embedded with part of the projectile still protruding from the target, and an associated automatic scoring arrangement, the target being divided into a plurality of separate beds each associated with a predetermined score that can be obtained by a player or sportsman causing a projectile to become embedded in that bed, each bed incorporating electrically conductive means for applying an electrical signal which is specific to that bed to a projectile embedded in said bed, the apparatus further including an aerial or antenna for receiving electromagnetic radiation radiating from part of a projectile protruding from a bed, and means responsive to a received signal for determining the score attributable to the projectile from which the radiation is emanating.

3. A target apparatus including:

a target in which projectiles may be embedded, said target including a target face, the target face being divided into a plurality of beds, the beds being formed from substantially parallel fibres that are, or have been treated to be, conductive at least on the outer surfaces of said fibres adjacent the face of said target, said fibres in each bed extending substantially normally to the target face and being insulated from the fibres in adjacent beds; and at least one transmitting/receiving projectile, said conductive fibres comprising a means for passing electromagnetically transmitted signals between a bed and said at least one transmitting/receiving projectile embedded in said bed.

4. A target according to claim 3, further including a backing means for mounting said fibres substantially normal to said backing member, each of said fibres having a free end, where the free ends of said fibres define said target face.

5. A target according to claim 4 wherein the fibres in adjacent beds constituting the target are insulated from each other by a separator member formed of insulating material and having at least one inner conductor, said inner conductor acting as an electric shield between the two beds.

6. A target according to claim 3 or 4, wherein the fibres are vegetable fibres that have been at least partly coated with metal or with conductive metal oxide.

7. A target apparatus comprising a target of the type into which a projectile of conductive material may be embedded with a part of the projectile remaining protruding from the target, and an associated automatic scoring system, the target being divided into a plurality of separate beds, each bed associated with a predetermined score that can be obtained by a player causing a projectile to become embedded in that bed, each bed incorporating electrically conductive means for conducting a signal so that a projectile embedded in said bed will act as a first antenna for electromagnetic radiation corresponding to said signal, said apparatus further including a second antenna for receiving said electromagnetic radiation, thereby comprising means responsive to a signal transmitted by one of said antenna and received by the other of said antennae for determining the score attributable to the projectile.

8. A target apparatus according to claim 7, including means for supplying a phase signal to one of said antennae, and means for supplying an anti-phase signal to said responsive means such that no response is produced in said responsive means when no projectile is embedded in said bed, and an increase in received phase signal results when said projectile becomes embedded in said bed.

9. A target system for indicating the position and/or score of a projectile embedded therein, said target system comprising:

target means comprising a plurality of beds, each of said beds being electrically conductive;

projectile means, at least partially embeddable in one of said beds, for conducting an electrical signal;

antenna means for conducting an electrical signal;

means, electrically connected to one of said plurality of beds and said antenna means, for generating said electrical signal;

means, electrically connected to the other of said plurality of beds and said antenna means, for receiving said electrical signal; and means, responsive to said receiving means, for indicating in which of said beds said projectile means is embedded.

10. A target system according to claim 9 wherein means are provided for supplying a phase signal to each bed, and means are provided for supplying an anti-phase signal to the said responsive means so that no response is produced when no dart is embedded in the bed, the responsive means or detector being responsive to the increase in phase signal received or detected when a dart becomes embedded in the said bed.

11. A target apparatus according to claim 10, wherein the means for supplying the anti-phase signal supplies the anti-phase signal directly to the said responsive means.

12. A target system according to claim 9 wherein means are provided for supplying a plurality of separate individually identifiable signals to the beds, a separate respective signal being supplied to each bed, the said responsive means including means for identifying each received or detected signal.

13. A target system according to claim 12, wherein a single signal generator is provided, the single signal being multiplexed successively between the beds.

14. A target system according to claim 9 wherein means are provided for detecting changes in the amplitude of a received signal to enable the system to detect the arrival of a second projectile in a bed in which a first projectile has already become embedded.

15. A target system according to claim 9 wherein the target is mounted on means adapted to provide an output signal indicative of wherever there is an increment in the weight of the target, signals thus being provided whenever a projectile becoms embedded in the target.

16. A target system according to claim 15 wherein a computing device receives the signals from the said responsive means, and from the weight monitoring means to provide signals to control a display board or panel.

* * * * *